US008490332B2

(12) United States Patent
Van Camp et al.

(10) Patent No.: US 8,490,332 B2
(45) Date of Patent: Jul. 23, 2013

(54) DOOR SILL ASSEMBLY WITH REPLACEABLE SILL DECK

(75) Inventors: Brent Van Camp, Colfax, NC (US); Andrew Krochmal, Greensboro, NC (US)

(73) Assignee: Endura Products, Inc., Colfax, NC (US)

( * ) Notice: Subject to any disclaimer, the term of this patent is extended or adjusted under 35 U.S.C. 154(b) by 23 days.

(21) Appl. No.: 13/009,449

(22) Filed: Jan. 19, 2011

(65) Prior Publication Data

US 2012/0180397 A1 Jul. 19, 2012

(51) Int. Cl.
*E06B 1/70* (2006.01)

(52) U.S. Cl.
USPC ..... 49/468

(58) Field of Classification Search
USPC ..... 49/467, 468; 52/211
See application file for complete search history.

(56) References Cited

U.S. PATENT DOCUMENTS

| | | | | |
|---|---|---|---|---|
| 1,910,260 | A | 5/1933 | Reher | |
| 2,089,380 | A | 8/1937 | Kammerer | |
| 3,032,837 | A | 5/1962 | Ramsey | |
| 3,032,839 | A | 5/1962 | Miller | |
| 3,402,512 | A | 9/1968 | Peterson | |
| 3,521,404 | A | 7/1970 | Hager et al. | |
| 3,774,343 | A | 11/1973 | Cribben et al. | |
| 3,962,828 | A * | 6/1976 | McAllister | 49/468 |
| 4,055,917 | A | 11/1977 | Coller | |
| 4,079,550 | A | 3/1978 | Bursk et al. | |
| 4,156,325 | A * | 5/1979 | McMullen et al. | 49/468 |
| 4,222,200 | A | 9/1980 | Beirnes | |
| 4,237,664 | A * | 12/1980 | Wilmes | 52/209 |
| 4,287,684 | A * | 9/1981 | McKann | 49/468 |
| 4,310,991 | A * | 1/1982 | Seely | 49/470 |
| 4,352,258 | A * | 10/1982 | Bursk et al. | 49/468 |
| 4,399,636 | A | 8/1983 | Blackwell | |
| 4,411,104 | A * | 10/1983 | St. Aubin | 49/470 |
| 4,447,987 | A | 5/1984 | Lesosky | |
| 4,473,981 | A | 10/1984 | Simpson | |
| 4,513,536 | A | 4/1985 | Giguere | |
| 4,578,905 | A | 4/1986 | Hout | |
| 4,945,680 | A | 8/1990 | Giguere | |
| 4,956,952 | A | 9/1990 | Bancroft | |

(Continued)

OTHER PUBLICATIONS

Application as filed (U.S. Appl. No. 10/683,312, filed Oct. 10, 2003); Final Office Action, mailed Jan. 11, 2008; Notice of Abandonment, mailed Jul. 25, 2008, pp. 1-30.

(Continued)

*Primary Examiner* — Katherine Mitchell
*Assistant Examiner* — Justin Rephann
(74) *Attorney, Agent, or Firm* — Womble Carlyle Sandridge & Rice, LLP

(57) ABSTRACT

A door sill assembly for an entryway of a building can include a substrate having a nosing and a sill channel. A nosing cover can be attached to the substrate and extending over at least a portion of the nosing and over at least a portion of the sill channel. A sill deck can be on the substrate. The sill deck can include a deck and a clip. The deck can be engaged with a portion of the nosing cover. The clip can be operably engaged with the deck. The clip can be removably attachable to the substrate. The sill deck is capable of removable attachment from the door sill assembly before or after the door sill assembly is installed in the entryway.

16 Claims, 13 Drawing Sheets

U.S. PATENT DOCUMENTS

| | | | | |
|---|---|---|---|---|
| 5,012,614 | A | 5/1991 | Shea | |
| 5,230,181 | A * | 7/1993 | Geoffrey et al. | 49/469 |
| 5,283,977 | A | 2/1994 | Smith | |
| 5,426,894 | A | 6/1995 | Headrick | |
| 5,517,788 | A * | 5/1996 | McGough et al. | 49/468 |
| 5,524,391 | A | 6/1996 | Joffe et al. | |
| 5,588,266 | A | 12/1996 | Headrick | |
| 5,611,173 | A | 3/1997 | Headrick et al. | |
| 5,673,517 | A * | 10/1997 | Stanclift | 49/468 |
| 5,943,825 | A | 8/1999 | Procton et al. | |
| 6,006,375 | A | 12/1999 | Carr | |
| 6,044,600 | A | 4/2000 | McCollough | |
| 6,052,949 | A * | 4/2000 | Procton et al. | 49/506 |
| 6,138,413 | A | 10/2000 | Fehr | |
| 6,185,870 | B1 | 2/2001 | Mettler | |
| 6,216,395 | B1 | 4/2001 | Kelly | |
| 6,269,591 | B1 | 8/2001 | Kelly | |
| 6,289,635 | B1 | 9/2001 | Procton et al. | |
| 6,367,201 | B1 | 4/2002 | Massey et al. | |
| 6,371,188 | B1 | 4/2002 | Baczuk et al. | |
| 6,484,446 | B2 * | 11/2002 | Young | 49/469 |
| 6,625,941 | B2 | 9/2003 | Shaw | |
| 6,763,639 | B2 | 7/2004 | Bennett et al. | |
| 6,789,358 | B2 | 9/2004 | Procton et al. | |
| 6,829,864 | B2 | 12/2004 | Mitchell et al. | |
| 7,111,433 | B2 | 9/2006 | Kerscher | |
| 7,263,808 | B2 | 9/2007 | Massey et al. | |
| 7,266,929 | B1 | 9/2007 | Allred et al. | |
| 7,350,336 | B2 | 4/2008 | Bennett | |
| 7,389,611 | B2 | 6/2008 | Palenske | |
| 7,472,516 | B2 | 1/2009 | Pepper et al. | |
| 7,536,833 | B2 | 5/2009 | Baczuk et al. | |
| 7,600,346 | B2 | 10/2009 | Meeks | |
| 7,694,471 | B2 | 4/2010 | Meeks et al. | |
| 7,775,011 | B2 | 8/2010 | Baczuk et al. | |
| 7,788,863 | B2 | 9/2010 | Pepper et al. | |
| 8,061,086 | B2 | 11/2011 | Haun | |
| 2002/0194787 | A1 | 12/2002 | Bennett | |
| 2004/0128925 | A1 | 7/2004 | Massey | |
| 2004/0139667 | A1 | 7/2004 | Massey et al. | |
| 2004/0200152 | A1 | 10/2004 | Khanlarian | |
| 2004/0200153 | A1 * | 10/2004 | Khanlarian | 49/468 |
| 2005/0210754 | A1 * | 9/2005 | Ferrell | 49/468 |
| 2006/0053695 | A1 * | 3/2006 | Palenske | 49/468 |
| 2006/0096190 | A1 | 5/2006 | Baczuk et al. | |
| 2006/0112644 | A1 * | 6/2006 | Pepper et al. | 49/468 |
| 2006/0174545 | A1 * | 8/2006 | Young | 49/468 |
| 2006/0225364 | A1 | 10/2006 | Chen | |
| 2008/0172957 | A1 | 7/2008 | Kerscher | |
| 2008/0229669 | A1 | 9/2008 | Abdollahzadeh | |

OTHER PUBLICATIONS

Application as filed (U.S. Appl. No. 11/241,753, filed Sep. 30, 2005); Final Office Action, mailed Dec. 14, 2009; Notice of Abandonment, mailed Jun. 24, 2010, pp. 1-44.

Official Action for C.A. Patent Application Serial No. 2,753,768, dated Feb. 14, 2013, 3 pgs.

Official Action for U.S. Appl. No. 13/367,875, dated May 9, 2013, 9 pgs.

* cited by examiner

DOOR SILL ASSEMBLY WITH REPLACEABLE SILL DECK

CROSS-REFERENCE TO RELATED APPLICATIONS

This application is a continuation or continuation-in-part of U.S. Design patent application No. 29/376,419, filed Oct. 6, 2010, which is hereby incorporated herein by reference in its entirety.

FIELD OF THE INVENTION

The present invention relates generally to entry door sill constructions, and more particularly, to a door sill construction having a replaceable sill deck.

BACKGROUND OF THE INVENTION

Door sills can be damaged during shipment from the manufacturer to the construction site, or more commonly during construction of a building. Common causes include objects dropped on the sill, excessive traffic within a relatively short time period, or accidental application of paint or stucco to the door sill. Left unrepaired, the door sill will not function as originally designed, i.e., the damaged door sill will not provide an effective seal between the frame and door, nor will the door sill manage water intrusion that minimizes moisture accumulation. Unrepaired door sills do not have the desirable aesthetics that newly manufactured and installed door sills have.

There are solutions available to a building owner or contractor who installs the door systems. The damaged door sill can be completely cut out and replaced. While a new door sill may be aesthetically pleasing, this particular type of repair can damage the surrounding mullions, door jambs, astragals or other structures, compromising the entire stability or function of the entryway system. Replacing a door sill is also costly, and is rarely done. An alternative is to simply attach a metal cover patch to the exposed surface of the existing door sill. The metal patch is not aesthetically or functionally equivalent to the original, undamaged door sill. This repair can also be costly because it is cut and notched on-site in order to provide the proper fit to the door unit.

There is a need, therefore, for a door sill system that retains functionality, allows for easy replacement of door sill components, and can address any damage arising during shipping, installation, or construction.

SUMMARY OF THE INVENTION

The following presents a simplified summary of the invention in order to provide a basic understanding of some aspects of the invention. This summary is not an extensive overview of the invention and is not intended to identify key or critical elements of the invention or to delineate the scope of the invention. The purpose of this section is to present some concepts of the invention in a simplified form as a prelude to the more detailed description that is presented later.

A door sill assembly for an entryway of a building can include a substrate having a nosing and a sill channel. A nosing cover can be attached to the substrate and extending over at least a portion of the nosing and over at least a portion of the sill channel. A sill deck can be on the substrate. The sill deck can include a deck and a clip. The deck can be engaged with a portion of the nosing cover. The clip can be operably engaged with the deck. The clip can be removably attachable to the substrate. The sill deck is capable of removable attachment from the door sill assembly before or after the door sill assembly is installed in the entryway.

DETAILED DESCRIPTION

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art and all such alternate embodiments, modifications, and improvements are within the scope of the present invention.

Figure 1:
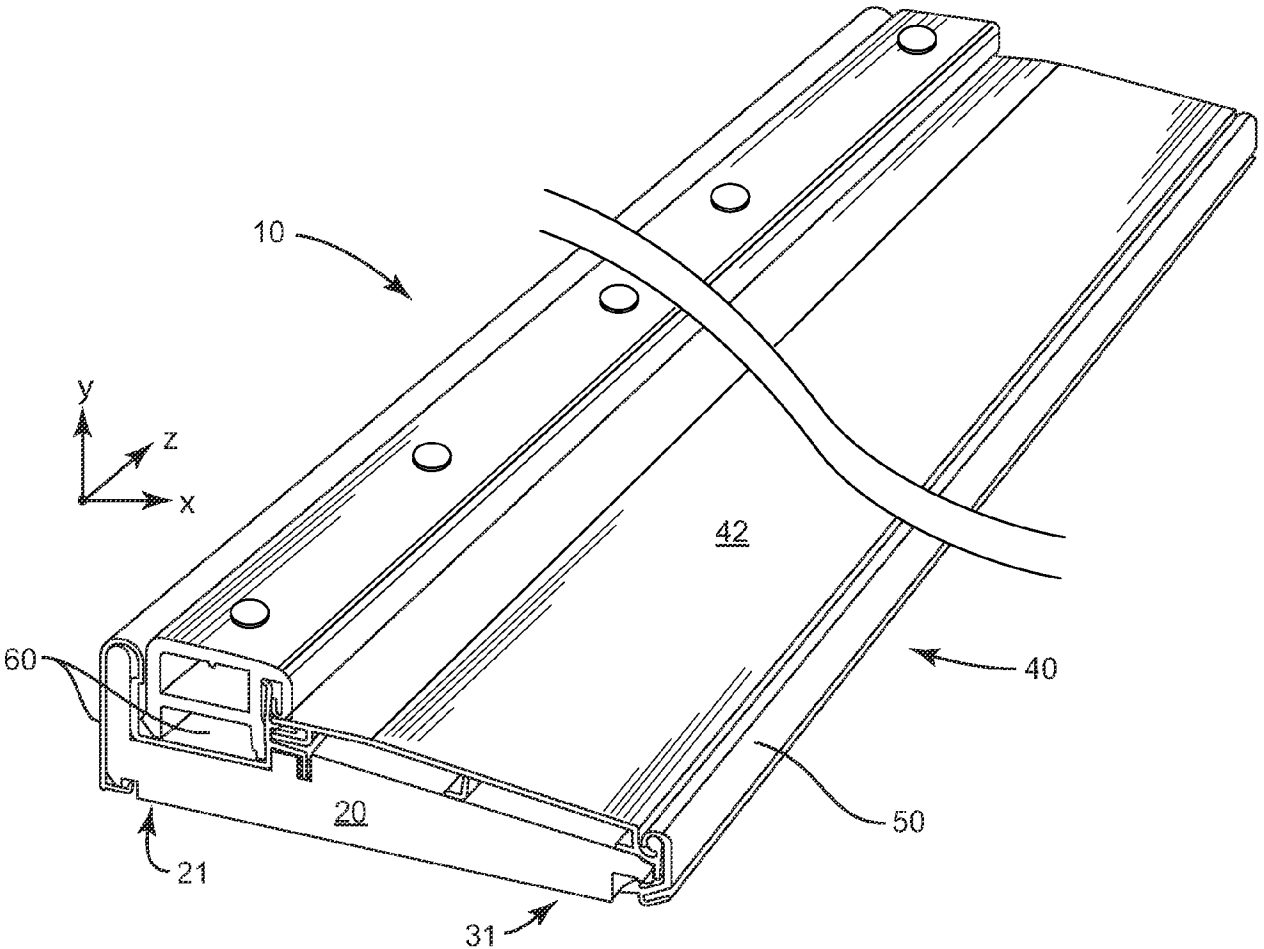
FIG. 1 is a front perspective view of a door sill assembly with a replaceable sill deck thereon according to a first embodiment of the invention.
Figure 2:
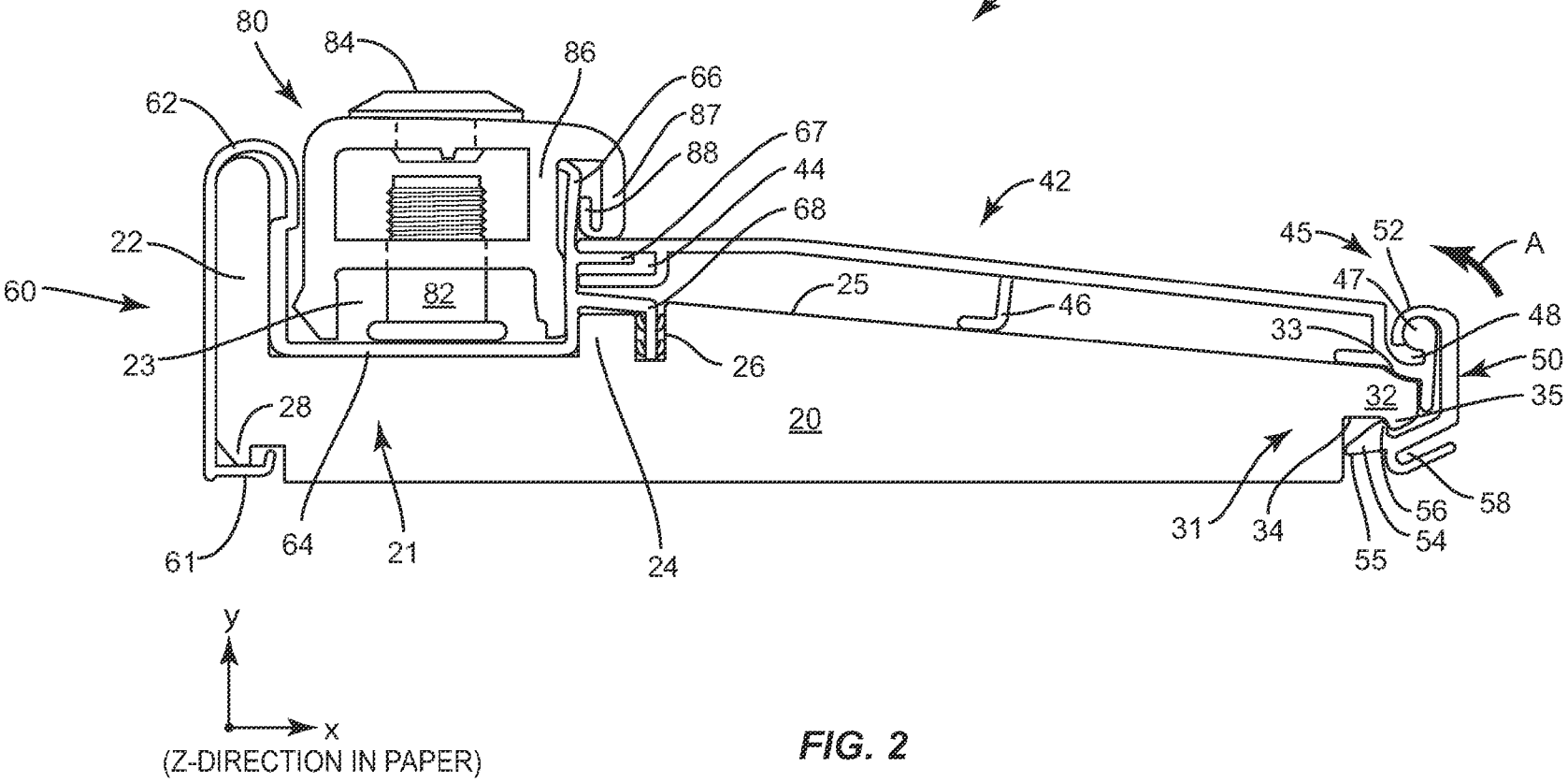
FIG. 2 is a side view of a door sill assembly with a replaceable sill deck thereon according to a first embodiment of the invention.
Figure 3B:
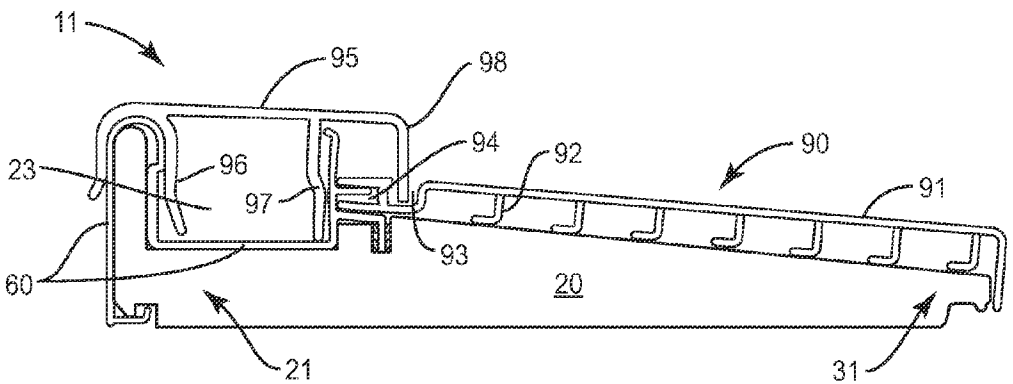
FIGS. 3A and 3B show front perspective and side views, respectively, of optional protective covers on a door sill assembly shown in FIGS. 1 and 2.
Figure 3A:
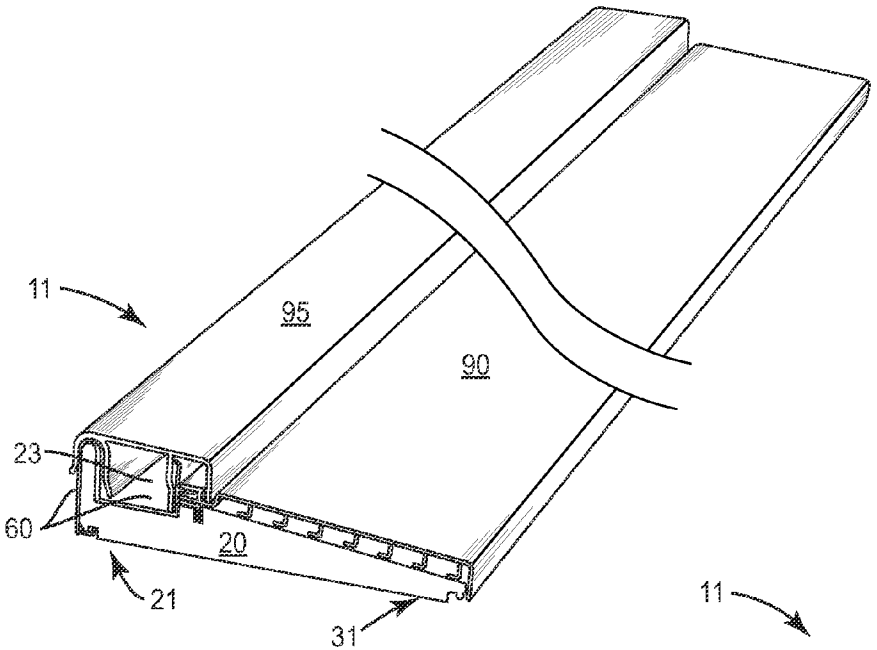

FIGS. 1 through 3B show door sill assemblies 10 and 11, and temporary protective covers 90 and 95, according to a first embodiment of the invention. As shown in FIGS. 1 and 2, the door sill assembly 10 includes a substrate 20 having an upwardly extending nosing 22 and substrate dam 24 defining a sill channel 23. The assembly 10 also includes a nosing cover 60 on the substrate 20, a sill cap 80 received by the sill channel 23, and a removable sill deck 40 engaged with the nosing cover 60 and substrate 20. The sill deck 40 includes a deck 42 connected to a clip 50. The clip 50 is on the substrate 20, and can pivot to allow removal of sill deck 40 from the door sill assembly 10 before or after installation of the door assembly in the building.

A conventional, e.g., 4-9/16 inch width, door sill assembly is shown in FIGS. 1 through 3B that can be used with single in-swing doors typical of entryways in residential homes. The door sill assembly, however, may have any particular width as the need may arise. FIGS. 4 through 9B show embodiments of a 5-5/8 inch wide door sill assembly with a replaceable sill deck and temporary protective covers. The embodiments shown in FIGS. 4 through 9B can also be used with single in-swing doors. In other embodiments, the door sill assemblies as described herein may be used with double in-swing doors, sliding door constructions, or outswing doors. FIGS. 10A through 11D show yet another embodiment of the invention wherein the door sill assembly comprises one or more mullions and one or more sidelight panels.

FIG. 2 shows how the substrate 20 can engage the nosing cover 60 and sill deck 40. The substrate 20 has a first end 21 near the inside of the building, the first end 21 including the nosing 22 and sill channel 23. A nosing lip 28 is located at the underside of the nosing 22 near the undersurface of the substrate 20. The nosing lip 28 receives a portion of the nosing cover 60, as will be further detailed below. The substrate second end 31 is opposite the first end 21 and can include a ledge 32 configured to receive the clip 50. In particular, the ledge 32 can have upper and lower surfaces 33 and 34, respectively, and a lip 35 to engage the clip 50.

The substrate 20 can be any material, including, but not limited to, wood, composite, polymeric or other rigid material. Additional fillers can be included in the substrates as needed, e.g., wood flour and/or materials other than the primary material. In one embodiment, the substrate can be integrally formed. For example, the substrate can be integrally formed as described in U.S. Pat. No. 6,789,358, the entirety of which is herein incorporated by reference. In another embodiment, the substrate can be integrally formed for the entirety of its length. In yet another embodiment, several substrate sections of the substrate can abut one another or connect together to form the support structure for the door sill.

As shown in FIG. 2, the nosing cover 60 includes lower portion 61, nosing portion 62 covering the upper surface of the nosing 22, sill channel portion 64, and a dam portion 66 having first and second projections 67 and 68. The nosing cover lower portion 61 engages the nosing lip 28 on the undersides of the substrate 20 to secure the nosing cover 60 to the first end 21 of the substrate 20. The nosing portion 62 extends over the nosing 22 and turns down toward the substrate 20 to cover at least a portion of the surface of the sill channel 23 forming the sill channel portion 64. In the embodiment shown, sill channel portion 64 covers all of the surface of the sill channel 23.

The dam portion 66 extends upwardly from the sill channel portion 64. In a preferred embodiment, the dam portion 66 is adjacent to, and can extend vertically past the top of the substrate dam 24. First and second projections 67 and 68 respectively can extend over the substrate dam 24 and engage the deck 42 and the substrate 20, respectively. More specifically, the first projection 67 can be received by a deck channel 44, and the second projection 68 can be received within an opening 26 on the substrate 20. The second projection 68 is shown with multiple sealing fins that help form a water and vapor seal when second projection 68 is placed in the opening 26. In another embodiment, the first projection 67 can have sealing fins also. The first projection 67 and second projection 68 can extend from dam portion 66 along the length (along the Z-axis as shown in FIG. 1) of the nosing cover 60. In alternate embodiments, however, the first and second projections 67 and 68 can be formed by several spaced-apart segments. Although two projections 67 and 68 are shown in FIG. 2, more than two projections can be used to engage with the sill deck 40 and substrate 20.

In alternate embodiments, however, the nosing cover 60 can include a nosing portion 62 and sill channel portion 64 in the sill channel 23 (not shown). The nosing cover, nosing portion and sill channel portion 64 can extend the length of the sill.

Continuing with FIGS. 1 and 2, the nosing cover 60 can extend down the length (Z-direction) of the door sill assembly. So configured, the nosing cover 60 helps form a water and vapor barrier and can help limit water seeping into the substrate 20. The nosing cover 60 allows water to drain into and seep through drain channels (not shown) at opposing sides of the door sill. Further, if one or more substrate portions are combined to form the substrate, the nosing cover 60 spans across the seams formed between adjacent substrate segments. Having a barrier over such seams can also help limit water intrusion.

FIG. 2 shows an adjustable sill cap 80 disposed in the sill channel 23 and on the nosing cover 60. The sill cap 80 includes an adjustable element 82 in the body 86, cap plug 84 and a leg 87. The leg 87 extends in the Y-direction and then down toward the sill deck 40. A flexible fin 88 on the distal end of leg 87 can contact the nosing cover dam portion 66 and deck 42 to form a seal. The seal can be an additional barrier to water intruding through the door sill assembly 10. In another embodiment for outswing type doors, the sill cap can have a leg extending in the Y-direction and then down toward the deck, and a bulb at the distal end of the leg to form a seal with the dam or the deck.

An installer, resident, or homeowner can remove cap plug 84 from the sill cap 80 and access the adjustment element 82. The adjustment element 82 can be rotated to cause adjustment of the sill cap 80 between a raised position (not shown) elevated above the substrate 20 and a lowered position. In other alternate embodiments, non-adjustable sill caps can be used.

As stated, the sill deck 40 includes a deck 42 and a clip 50, the clip being pivotally connected to the deck 42 in a preferred embodiment. The deck 42 and clip 50 together form the tread portion of door sill assembly 10. The deck 42 and clip 50 typically are formed of aluminum, or other material that is durable for use in an entryway.

As shown in FIG. 2, the deck 42 can include a channel 44, support leg 46, and a clip engaging end 45. The channel 44 receives the first projection 67 extending from the nosing cover 60. The support leg 46 can extend from the undersurface of the deck 42 to rest atop the substrate 20. One or more support legs can be used to support the deck 42, as needed. The clip engaging end 45 can include a knuckle joint 47 and a curvilinear slot 48 that engages the clip 50, and a lower surface that can form-fit to the distal end of the substrate ledge 32. The slot 48 can receive a curved clip leg 52 that is slidable in the Z direction therein.

The sill deck 40 removal is accomplished by taking advantage of the design of the deck 42 and clip 50. As shown in FIG. 2, the clip 50 can also include clip end 54 configured to engage a lip 35 on the undersurface on substrate ledge 32. More specifically, the clip end 54 can have a first engagement point 55, and a second engagement point 56 that releaseably extends over the lip 35. The clip engaging end 45, resting on ledge upper surface 33, and the clip engagement points 55 and 56 engaged with the second end 31 of the substrate 20 limit vertical (Y-direction) and horizontal (X-direction) displacement of the clip 50. Because the clip 50 is also connected to the deck 42 at the knuckle joint 47, the deck 42 is pressed into engagement with the projection 67 of the nosing cover 60, vertical and horizontal displacement of the sill deck 40 is minimized. To facilitate removal, a slot 58 can be positioned proximate to the clip end 54 and can be designed to receive a tool, e.g., a screw driver, flat edged tool or the like. A user inserts the tool into the slot 58 and can force the clip end 54 from beneath the substrate ledge 32 so that the clip leg 52 rotates about the knuckle joint 47, thereby pivoting the clip 50 about the deck 42 in the direction of arrow A as shown.

Once the clip 50 is removed from the substrate 20, the deck 42 can be disengaged from the projection 67 by sliding the deck 42 in the X-direction, thereby allowing the entire sill deck 40 to be completely removed from the door sill assembly 10 and frame structure. Sill deck 40 removal occurs without modification or damage to the frame structure, and without disassembly of the door sill 10. A new sill deck with a deck and clip can then be removeably attached onto the substrate 20 by reversing the above steps, thereby preserving the originally designed functionality and aesthetics of the installed door sill.

The scope of this invention also includes the use of optional temporary protective covers, which can later be removed and discarded, and replaced with a sill deck upon completion of the construction. Temporary protective covers can be placed on door sill assembly 10 during door assembly manufacture, or during installation of the door sill assembly in the building. The temporary protective covers allow a pre-hung door to be assembled and shipped to the job site without the final sill deck and sill cap assembly attached, thus minimizing damage risk to these door sill components. In the embodiment shown in FIGS. 3A and 3B, a door sill assembly 11 can include a temporary deck protective cover 90 and temporary sill cap protective cover 95. The temporary deck protective cover 90 includes a deck surface 91 and a plurality of supports 92 extending therefrom to rest on the substrate 20. A channel 94 receives one of the projections extending from the nosing cover 60. The protective sill cap cover 95 can be placed over the nosing cover 60 to protect the sill channel 23. The sill cap protective cover 95 includes a first leg 96 and a second leg 97 that can provide support and contact the nosing 22 and sill channel 23. An extension leg 98 engages a channel 93 in the deck surface 91, securing the deck protective cover 90 in place. The temporary protective covers 90 and 95 can be removed once construction of the building is complete and discarded as waste. A replaceable sill deck as described above can then be installed.

Figure 4:
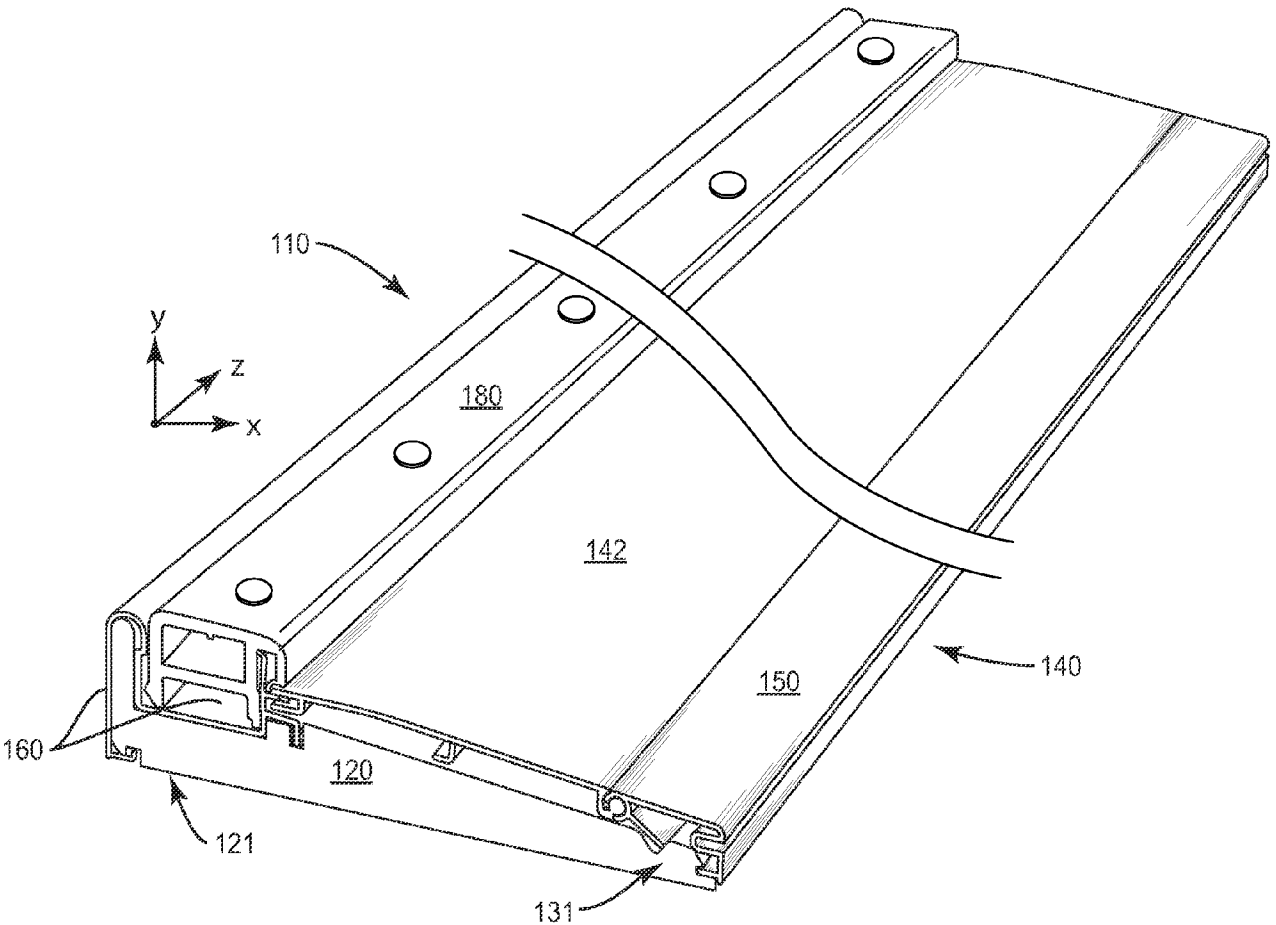
FIG. 4 is a front perspective view of a door sill assembly with a replaceable sill deck thereon according to a second embodiment of the invention.
Figure 5:
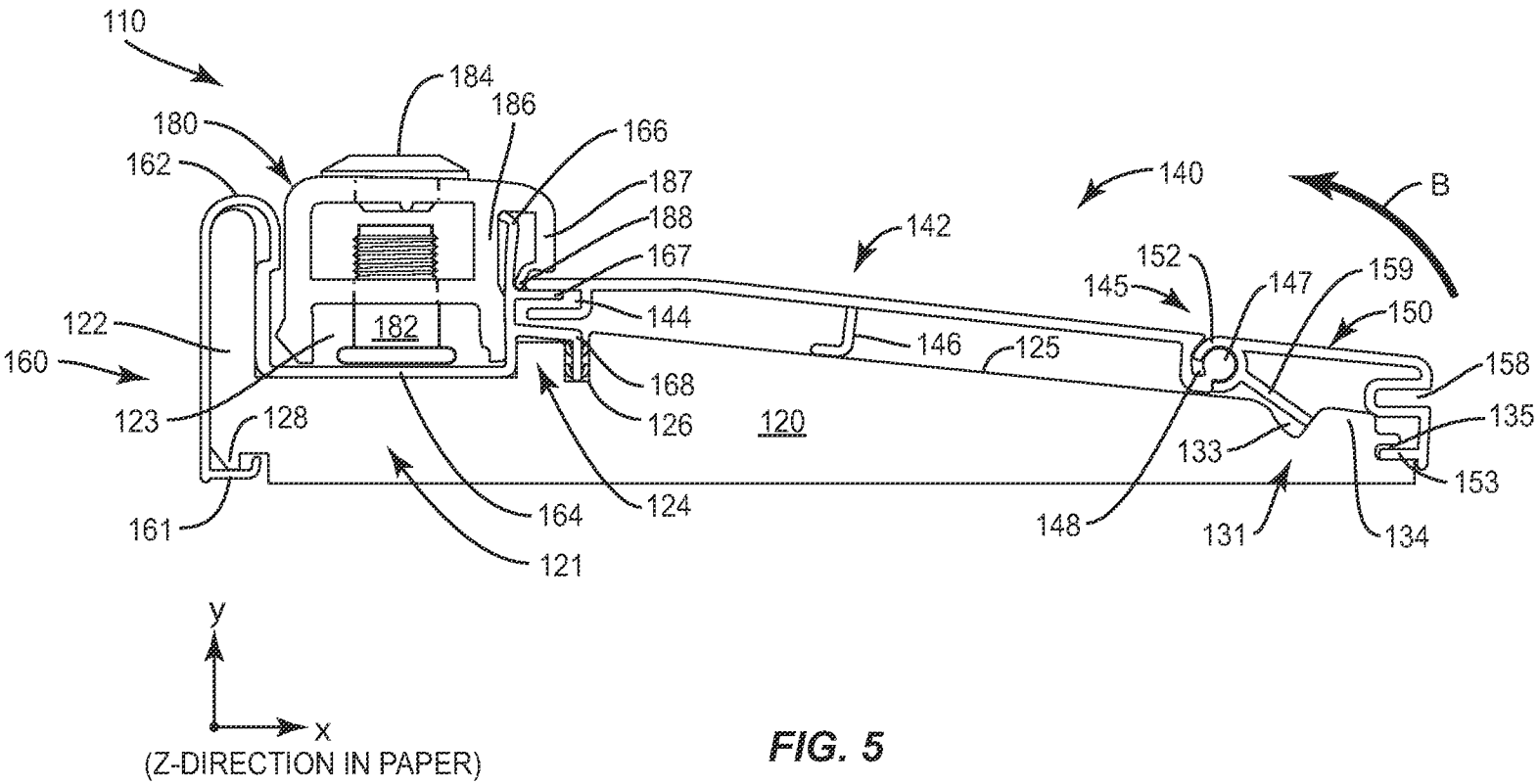
FIG. 5 is a side view of a door sill assembly with a replaceable sill deck thereon according to a second embodiment of the invention.

FIGS. 4 through 6B show another door sill assembly, according to a second embodiment. While the embodiment shown can be used with doors of various widths, in one embodiment the door sill assembly is a 5-⅝ inch wide door sill. As shown in FIGS. 4 and 5, the door sill assembly 110 includes a substrate 120, nosing 122 and substrate dam 124. Also shown is a sill channel 123, nosing cover 160, sill cap 180 in the channel 123, and a replaceable sill deck 140. The nosing cover 160, sill channel 123, sill cap 180, and the first end 121 of the substrate 120 are constructed and function similar to the equivalent components of the embodiment described above and shown in FIGS. 1 and 2. As shown best in FIG. 5, however, the second (or outside-facing) end 131 of the substrate 120 includes an indentation 133 near the ridge 134, and a slot 135 positioned at the distal end of the substrate 120. The indentation 133 can receive a first clip leg 159 while the slot 135 receives a second clip leg 153. Details of the clip 150 are discussed below.

As shown in FIGS. 4 and 5, the sill deck 140 includes a deck 142 and an interconnected clip 150. The deck 142 includes a channel 144 for engaging the nosing cover 160, at least one support leg 146, and a clip engaging end 145 shown in this embodiment as pivotally connecting to the clip 150. The channel 144 receives a first projection 167 extending from the nosing cover 160. The support leg 146 extends from the undersurface of the deck 142 to rest atop the substrate 120. One or more support legs can be used to support the deck 142, as needed. The clip engaging end 145 includes a knuckle joint 147 and a curved slot 148 that receives a portion of the clip 150. The lower surface of the clip engaging end 145 can rest on the upper surface 125 of the substrate 120.

As shown in FIG. 5, the clip 150 includes a curved clip leg 152, first and second clip legs 159 and 153, and a slot 158 for receiving a tool. The curved clip leg 152 slidably (in the Z-direction) fits within the slot 148, connecting the clip 150 to the deck 42. The first clip leg 159 extends from the knuckle joint 147 into the indentation 133, while the second leg 153 is received in the substrate slot 135. The clip legs 153 and 159 when engaged with the second end 131 of the substrate 120 limit vertical (Y-direction) and horizontal (X-direction) displacement of the clip 150. Because the clip 150 is also connected to the deck 142 at the knuckle joint 147, the deck 142 is pressed into engagement with the projection 167 of the nosing cover 160, vertical and horizontal displacement of the sill deck 140 is minimized. A tool can be inserted into the slot 158 and rotated to release the clip leg 153 out of the slot 135. The clip 150 can pivot in the direction of arrow B to disengage from the substrate 120 and nosing cover 160. This allows the sill deck 140 to be completely removable from the door sill assembly 110 without cutting, modifying, or damaging the surrounding frame structure of the door sill assembly, or disassembling the door sill. A new sill deck can be placed on the substrate and nosing cover as needed.

Figure 6A:
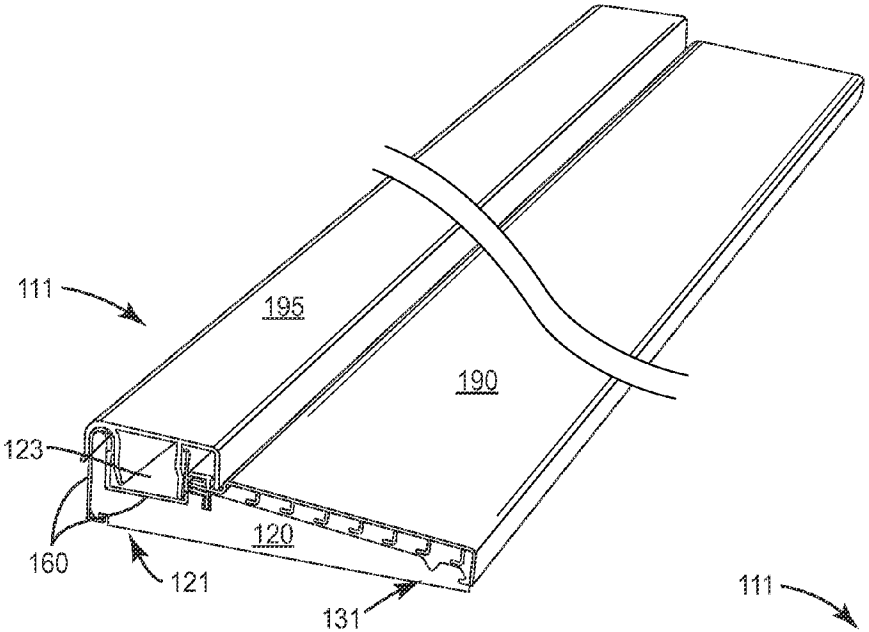
FIGS. 6A and 6B show front perspective and side views, respectively, of optional protective covers on the door sill assembly shown in FIGS. 4 and 5.
Figure 6B:
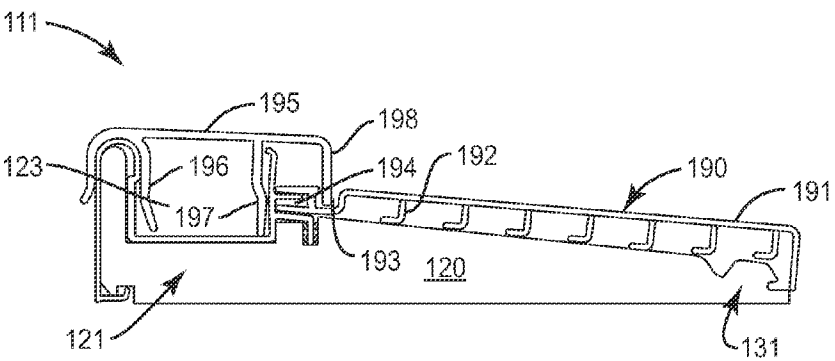

FIGS. 6A and 6B show a door sill assembly 211 with optional temporary protective covers that fit the substrate described in FIGS. 4 and 5 above. The covers 190 and 195 function similarly to the protective covers described above and shown in FIGS. 3A and 3B. The deck protective cover 190 includes a deck surface 191 and a plurality of supports 192 extending therefrom to rest on the substrate 120. A channel 194 receives one of the projections extending from the nosing cover 160. The temporary protective sill cap cover 195 can be placed over the nosing cover 160 to protect the sill channel 123. The sill cap protective cover 195 includes a first leg 196 and a second leg 197 that can be placed upon the nosing 122 and sill channel 123. An extension leg 198 engages a channel 193 in the deck surface 191, securing the deck protective cover 190 in place. In an embodiment, the temporary covers 190 and 195 can be installed on door sill assembly 111 and shipped to the construction site. The door sill assembly 111 can be installed in the building entryway. The protective covers 190 and 195 can be removed once construction of the building is complete and discarded. A replaceable sill deck as described above can be installed.

Figure 7:
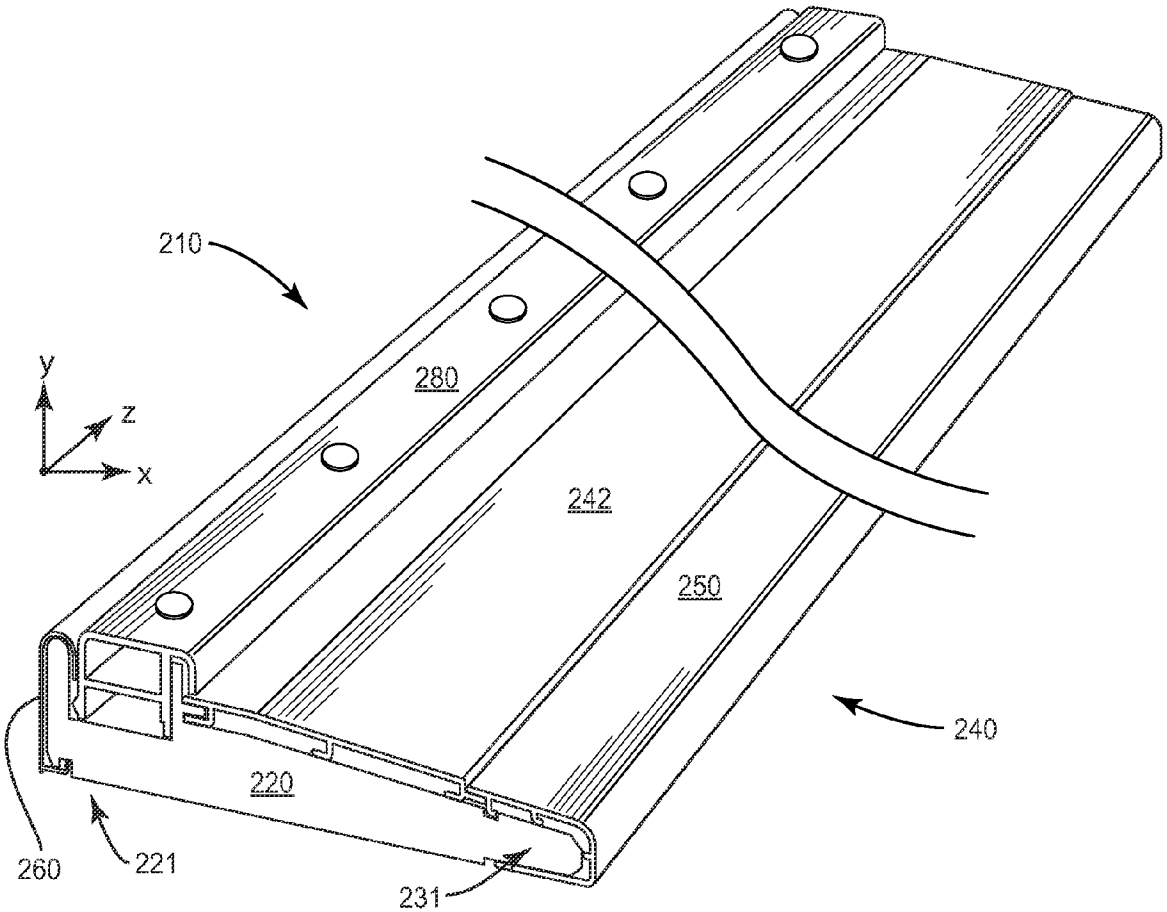
FIG. 7 is a front perspective view of a door sill assembly with a replaceable sill deck thereon according to a third embodiment of the invention.
Figure 8:
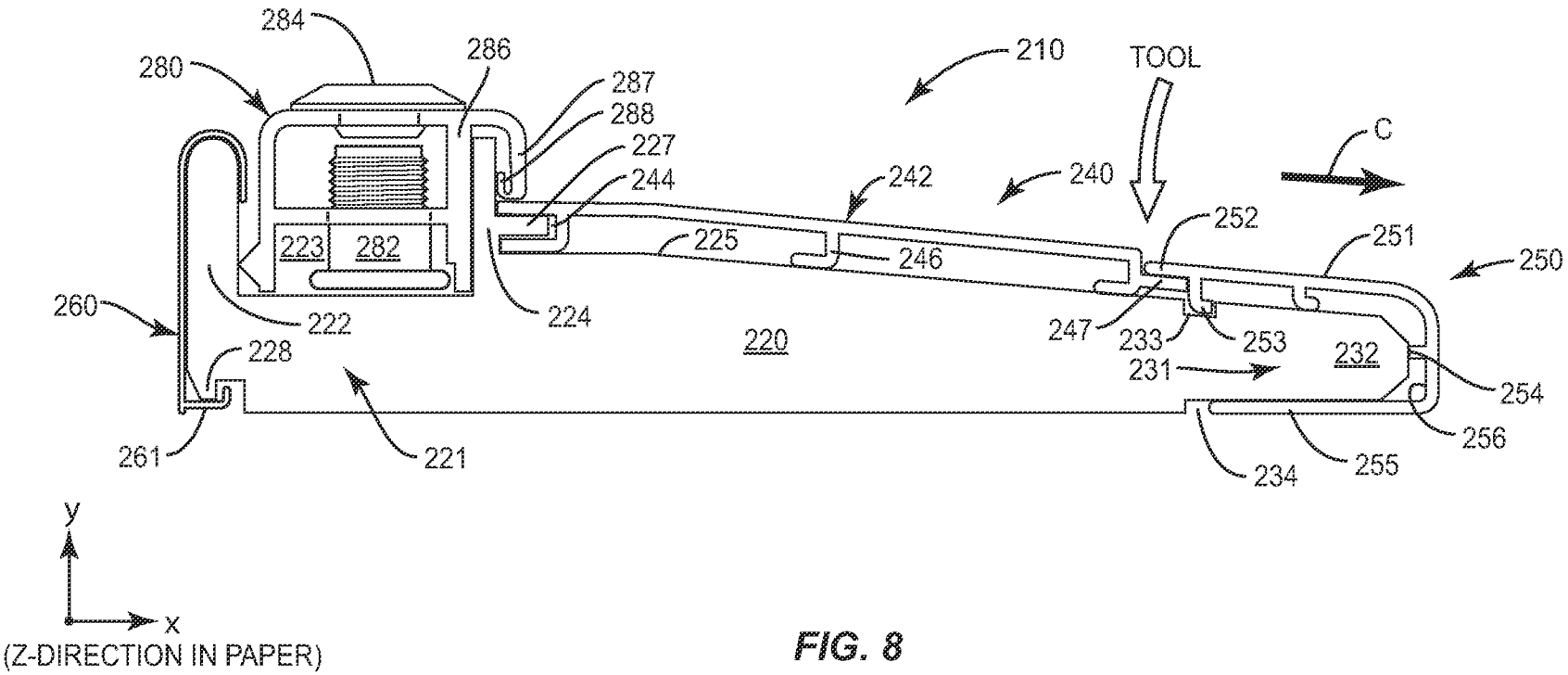
FIG. 8 is a side view of a door sill assembly with a replaceable sill deck thereon according to a third embodiment of the invention.

FIGS. 7 through 9B show a door sill assembly 210 according to a third embodiment of the invention. Turning to FIGS. 7 and 8, the door sill assembly 210 includes a substrate 220 having an upwardly extending nosing 222 and dam 224, a nosing cover 260 attached to the substrate 220, and a sill cap 280 in the sill channel 223.

FIG. 8 shows how the substrate 220 engages the nosing cover 260 and sill deck 240. The substrate 220 includes a first end (or inside facing end) 221, and an opposite second end 231. The first end 221 includes an upwardly extending nosing 222 and a dam 224 forming a sill channel 223 therebetween that is sized to receive the sill cap 280 as shown. A projection 227 extends in the X-direction from the dam 224 to receive the deck 242. While one projection is shown, one or more projections can be used. Further, other configurations could be employed for securing the deck 242 to the substrate 220, preferably in the X- and Y-directions.

The second end 231 of the substrate 220 includes a ledge 232, an indentation 233, and an undersurface 234 that represents in this embodiment a cutaway or relief in this portion of the substrate 220. The ledge 232 is configured to receive the clip 250, as described below.

The substrate 220 shown in FIG. 8 can be integrally formed to include the nosing, dam, and projections. Further, the substrate 220 can be formed similarly to the substrates as described in the embodiments above and shown in FIGS. 1 through 6B.

As shown in FIGS. 7 and 8, the nosing cover 260 includes a lower ledge 261 secured to a lower lip 228 of the substrate 220. The nosing cover 260 extends just over the top of nosing 222 and extending but not reaching the top of the substrate 220 in the sill channel 223. In other embodiments, however, a nosing cover 260 can include a nosing portion, sill channel cover portion, and an upwardly extending dam, as described above and shown in FIGS. 2 and 5.

FIGS. 7 and 8 show an adjustable sill cap 280 disposed on the sill channel 223. The sill cap 280 includes a body 286 having an adjustment element 282 disposed thereon and resting atop substrate 220. A leg 287 extends downwardly toward the sill deck 250 from the body 286 and spaced therefrom to receive the dam 224. The sill cap 280 function similar to embodiments described above. For outswing doors, however, the sill cap leg 287 can include a bulb (not shown) at its distal end to seal with deck 242. Further, other features typical of outswing sill caps can be used with replaceable sill decks and nosing covers as described herein.

As shown in FIGS. 7 and 8, the sill deck 240 includes a deck 242 and moveable clip 250. The deck 242 engages both the substrate 220 and clip 250, while the clip 250 engages the second end 231 of the substrate 220. The deck 242 includes a channel 244, a support leg 246, and a deck platform 247 for positioning with the clip 250. The channel 244 is sized to receive the projection 227 extending from the dam 224. A support leg 246 extends from the deck 242 and rests atop the substrate 220 to support the deck 242. More than one support leg can be used as needed.

As best shown in FIG. 8, the clip 250 has a top 252, bottom 255, and inner surface 256 that fits around the substrate ledge 232. A plurality of legs 253 and 254 extended from the inner surface 256 to removeably engage the substrate ledge 232. The first leg 253, as described above, is received within the indentation 233. The second leg 254 extends inwardly in the X-direction to contact the distal end of the substrate ledge 232. The top 252 rests upon a deck platform 247 and the bottom 255 is received on the undersurface 234 of the ledge 232.

When the clip 250 engages the deck 242, the clip top 252 rests on the deck platform 247. The legs 253 and 254 limit horizontal (X-direction) displacement of the clip 250 about the substrate 220 while the top 252 and bottom 255 limit vertical (V-direction) displacement of the clip 250 about the substrate. Because vertical and horizontal displacement of the clip 250 is minimized, the deck 240 is pressed into engagement with the dam projection 227, vertical and horizontal displacement of the sill deck 240 about the door sill assembly 210 is minimized.

A tool can be used to separate the clip 250 from the deck 242 and substrate 220. A tool (not shown) can be inserted (see arrow marked TOOL) proximate the clip top 252 and rotated to move the clip top 252 away from the deck ledge 247. This movement will raise the leg 253 out of the indentation 233. This can then allow the clip 250 to slide in the X-direction of arrow C away from the deck 242. With the clip 250 removed from the substrate 220, the deck 242 can be removed from engagement with the dam projection 227 by moving the deck 242 in the same X-direction of arrow C. A new sill deck including a new deck and clip can be replaced on the door sill assembly by reversing these steps.

Figure 9A:
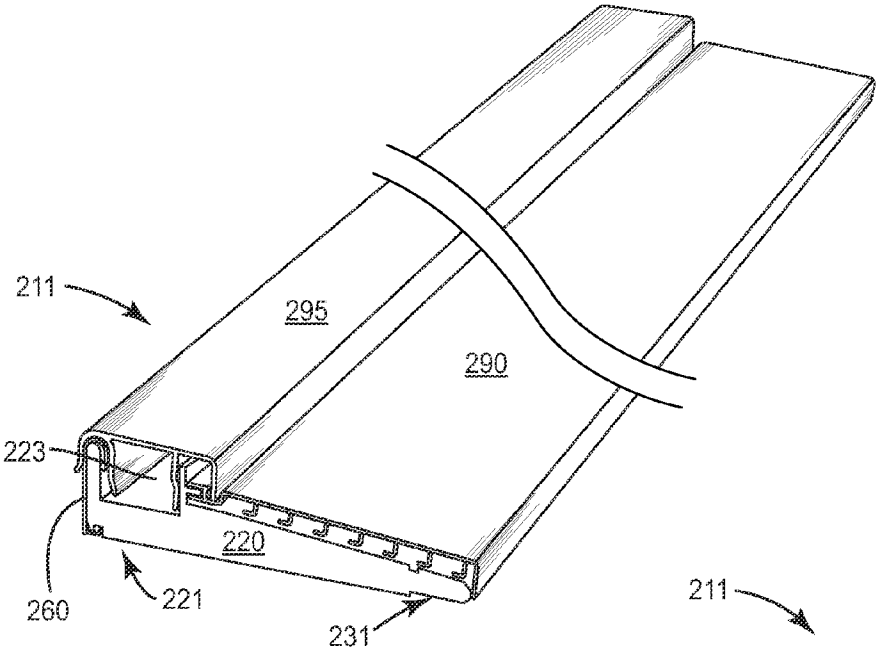
FIGS. 9A and 9B show front perspective and side views, respectively, of optional protective covers on the door sill assembly shown in FIGS. 7 and 8.
Figure 9B:
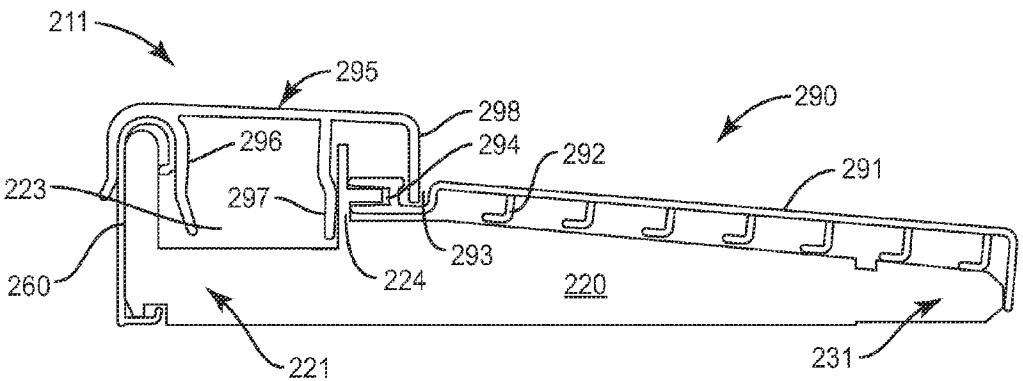

FIGS. 9A and 9B show a door sill assembly 211 with optional temporary protective sill deck covers, suitable for use with the substrate 220 described above. A deck protective cover 290 includes a deck surface 291 and a plurality of supports 292 extending therefrom to rest on the substrate 220. A channel 294 receives one of the projections extending from the dam 224. A protective sill cap cover 295 can be placed over the nosing cover 260 to protect the sill channel 223 (not numbered in FIGS. 9A and 9B). The sill cap protective cover 295 includes a first leg 296 and a second leg 297 that can contact the nosing 222 and sill channel 223. An extension leg 298 engages a channel 293 in the deck surface 291, securing the deck protective cover 290 in place. The protective covers 290 and 295 can be removed once construction of building is complete and the replaceable sill deck as described above can be installed.

Figure 10A:
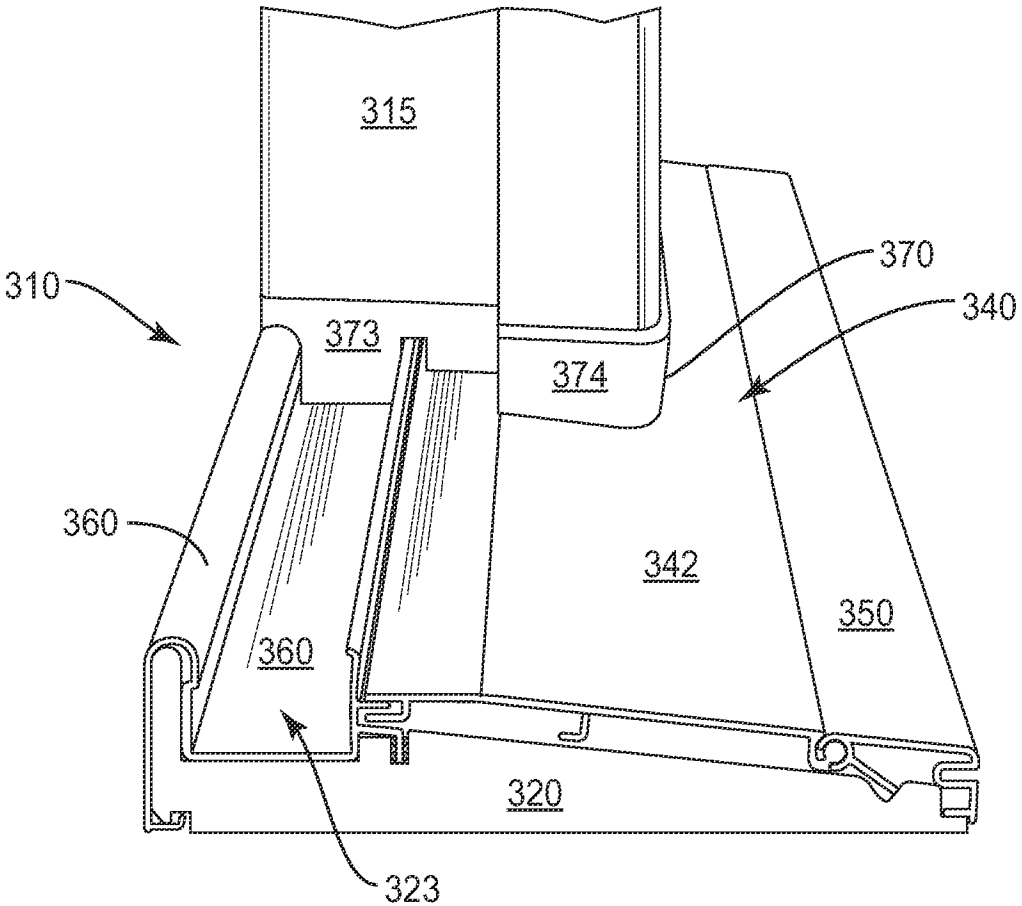
FIGS. 10A and 10B show side perspective and front perspective assembly views, respectively, of a door sill assembly installed in an entryway having a mull and a sidelight panel according to another embodiment of the invention.

FIGS. 10A through 10D show yet another embodiment of a door sill assembly 310 with a replaceable sill deck 340 for installation in an entryway with a side light 500. Sidelight-type entryways include mullion or mull 315 engaged with the door sill assembly 310. As shown in FIG. 10A, the door sill assembly 310 includes a substrate 320, a nosing cover 360, sill channel 323 and a replaceable sill deck 340. A sill cap 380 can be used in the door sill assembly on one side of mull 315 (the sill deck 340 is removed from FIG. 10B for illustrative purposes). A sidelight cap 510 is disposed on the other side of the mull 315 in sill channel 323 (not shown). The replaceable sill deck 340 can engage the nosing cover 360 and substrate 320 as described in the embodiments above and shown in FIGS. 1 through 9B, although FIG. 10 shows the embodiment of FIGS. 4-5.

Figure 10C:
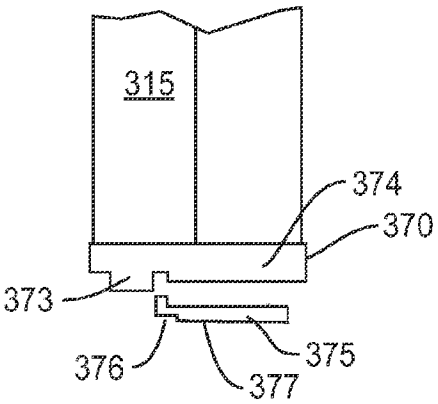
FIGS. 10C and 10D show a partial side assembly and partial front views, respectively, of a mull and mull riser used on a door sill assembly shown in FIGS. 10A and 10B.
Figure 10D:
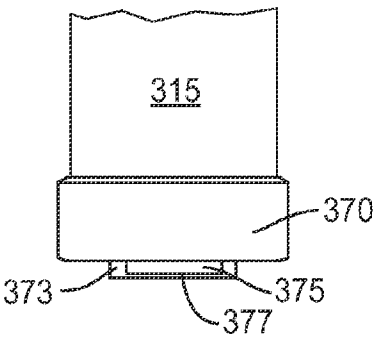
Figure 10B:
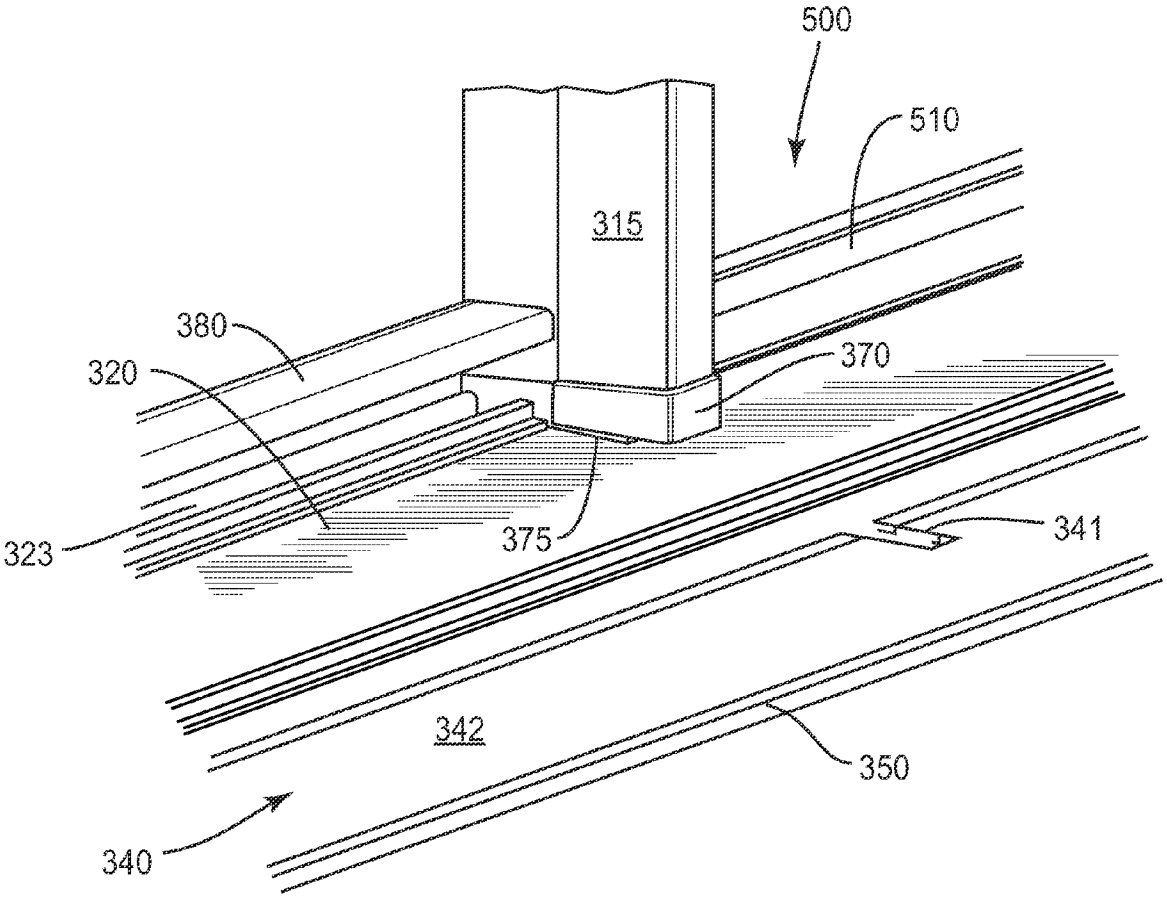

FIGS. 10B, 10C and 10D illustrate how the mull 315, mull boot 370 and mull riser 375 cooperate to allow the mull 315 to engage the door sill assembly 310, yet permit sill deck 340 replacement when needed. In particular, the mull boot 370 includes a sill channel engaging end 373, and a sill deck engaging end 374, each having a bottom that fits the profile of the nosing cover 360 and sill deck 340.

As shown in FIGS. 10B, 10C and 10D, a mull riser 375 can be placed on (and optionally secured) to the bottom surface of the mull boot 370. The mull riser 375 elevates the mull boot 370 above the substrate 320 so that the sill deck 342 can slide partially between the mull 315 and substrate 320 and engage the nosing cover 360 and substrate 320. The mull riser 375 includes an opening (not shown) for a mechanical fastener to be placed therethrough to secure the substrate 320, mull boot 370 and mull 315 together. As shown in FIG. 10C, the lower surface 377 of the mull riser 375 has a cut out 376 for engaging to nosing cover 360. The mull riser can be separate from the mull boot as shown. In other embodiments, the mull riser can be formed directly onto the bottom surface of the mull boot.

As shown in FIG. 10B, the deck 342 can have a notch 341 to receive the mull riser 375 as the deck 242 is placed on the substrate 320 and nosing cover 360. The notch 341 allows the deck 342 to engage the substrate 320 while allowing mull boot 370 to rest on the sill deck 340 and nosing cover 360. The door sill remain's stable and the frame structure remains unaffected by removal of the sill deck 340. The installer or user may form the notch 341 on the deck 342 prior to installation. In other embodiments, the notch 341 may be formed in the deck 342 during manufacture of the sill deck 340. Further, the deck 342 can include a longitudinal score line (not shown) that provides visual indication of where the terminal end of the notch 341 should be. This score-line allows for easy construction-site modification of the deck 342 during installation of the door sill assembly.

Figure 11A:
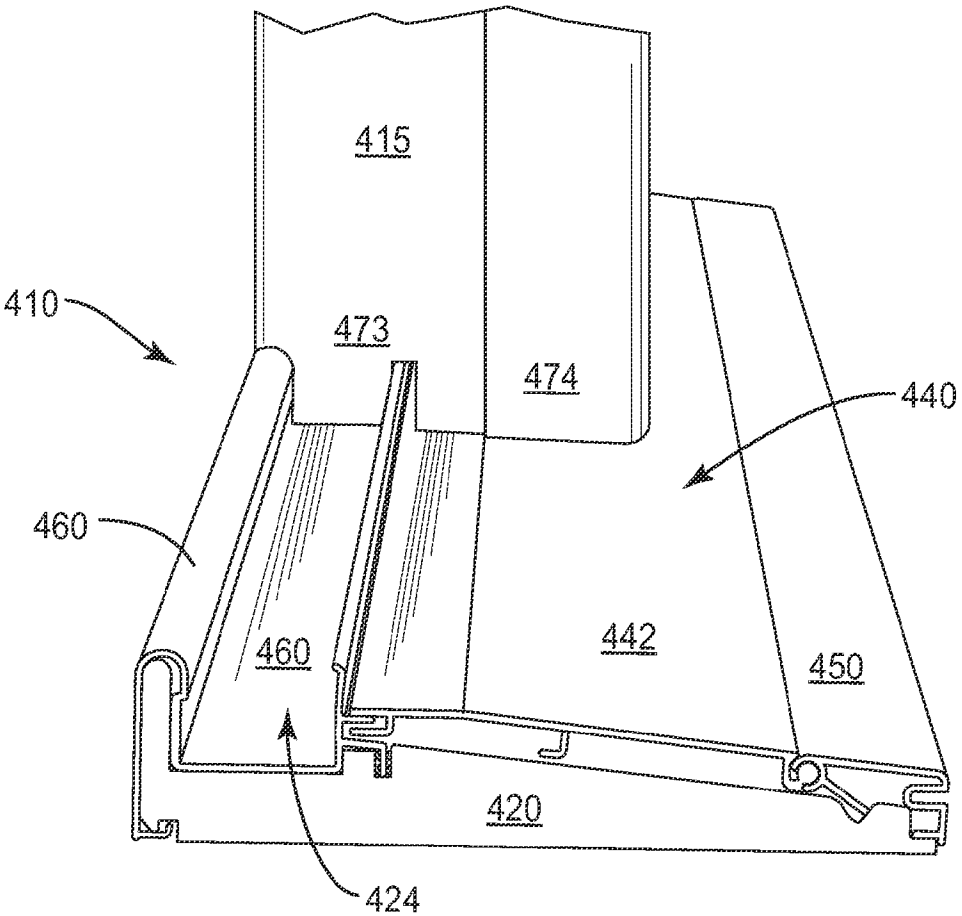
FIGS. 11A and 11B show side perspective, and front perspective assembly views, respectively, of a door sill assembly installed in an entryway having a mull and a sidelight panel according to another embodiment of the invention.
Figure 11C:
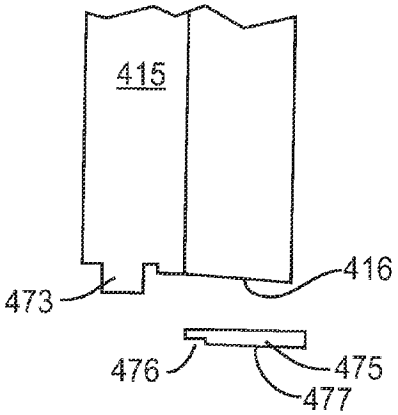
FIGS. 11C and 11D show a partial side assembly and partial front views, respectively, of a mull and mull riser used on the door sill assembly shown in FIGS. 11A and 11B.
Figure 11D:
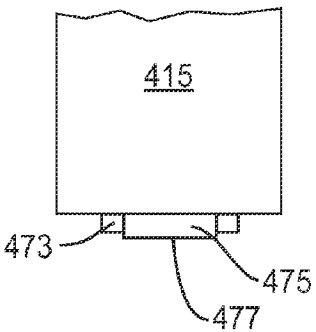
Figure 11B:
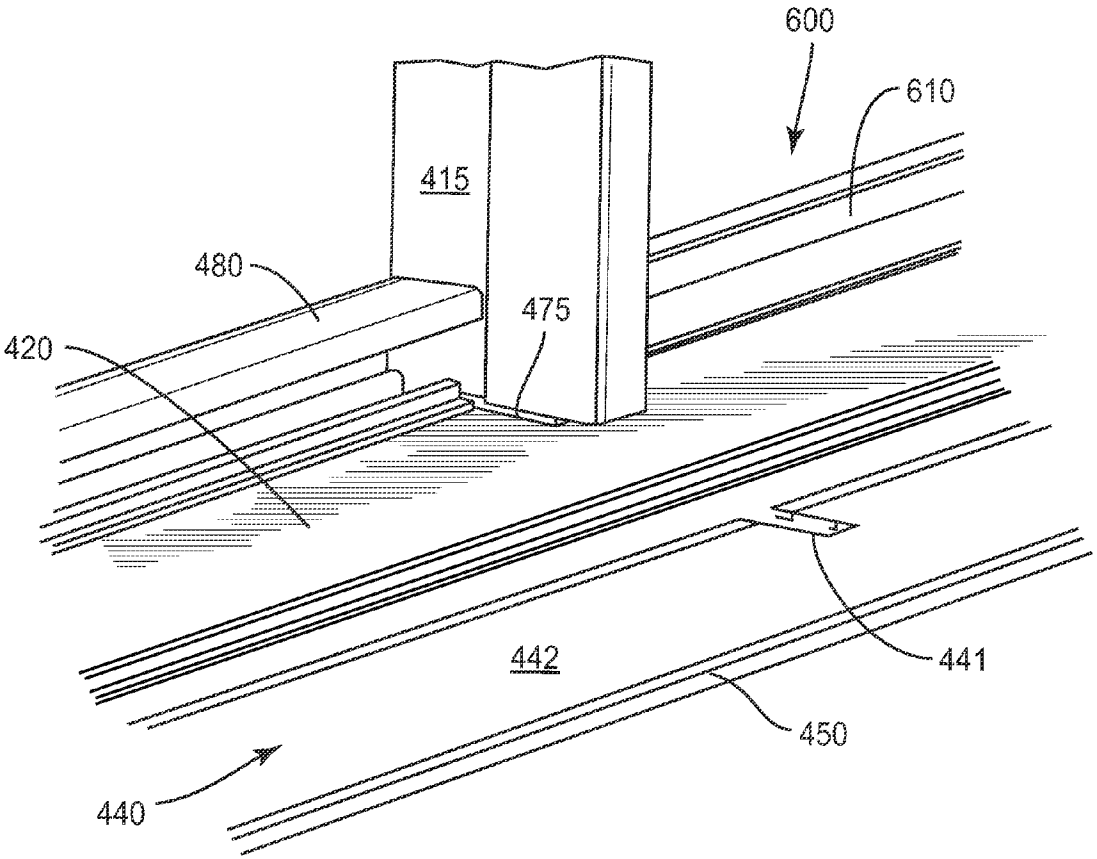

FIGS. 11A through 11C show another embodiment of a mull riser 475 for use with a mull 415 and a door sill assembly 410 installed an entryway having a sidelight 600 and sidelight cap 610. In the embodiment shown in FIGS. 11A through 11C, the mull riser 475 is secured to the bottom surface of the mull 415 and does not include a mull boot. The mull riser 475, as described above, elevates the mull 415 above the substrate 420 so that the sill deck 442 can slide between the mull 415 and the substrate 420 to engage the nosing cover 460 and sidelight cap 610. As shown in FIG. 11C, the mull riser lower surface 477 has a cut out 476 for engaging the nosing cover 460.

As described above, a notch 441 in the deck 442 receives the mull riser 475. While the mull riser 475 is shown as a separate component from the mull, in an alternate embodiment, the mull riser can be integrally formed onto the bottom surface of the mull. In addition, any of the temporary sill deck protective covers described above may include a suitable notch for receiving the mull risers.

Another embodiment of the invention is a method of using a replaceable sill deck. A door sill assembly can be provided that includes a substrate having a nosing and a sill channel. A nosing cover can be attached to the substrate and extending over at least a portion of the nosing and over at least a portion of the sill channel. A sill deck having a deck and a clip can be provided for removable attachment to the substrate and nosing cover. The deck can be placed onto and receive a portion of the nosing cover. The clip can be removably engaged with the substrate. To remove the sill deck, a tool can be used to position the clip out of engagement with the substrate and/or deck. The deck can then be removed from engagement with the nosing cover. Another sill deck can be replaced by reversing the above steps.

In another embodiment, the door sill assembly can include one or more temporary protective covers placed over a portion of the substrate engaged with the nosing cover. A first temporary protective cover can be placed on the sill channel and nosing cover. A second temporary protective cover can be placed on the substrate and engage the nosing cover or a substrate dam. The door sill assembly with one or more temporary protective covers can be installed in an entryway. When construction of the building is complete, the temporary protective covers can be removed from the door sill assembly. The replaceable sill deck having a deck and clip connected to the deck can be removeably attached to the substrate as discussed above.

The replaceable sill deck and temporary protective covers as described herein can be used with selectively positionable sill and panel caps in entryways having one or more fixed sidelight panels (not shown). Selectively positionable sill and panel caps are described in U.S. Pat. No. 5,426,894, the entirety of which is herein incorporated by reference. Entryways with fixed sidelight panels can have a continuous sidelight threshold and door sill assembly. A channel (similar to 23, 123 or 223 shown in FIGS. 2, 5, and 8, respectively), nosing cover (similar to 60, 160 or 260 in FIGS. 2, 5 and 8, respectively), can extend the length of the continuous threshold. The sill and panel caps can have a length (in the Z-direction as shown in the Figures) that is smaller than the length of the channel. A panel cap can be selectively positioned in the channel to underlie the fixed sidelight panel. The sill cap can also be selectively positionable in a sill channel to underlie the hinged door. Both the sill cap and panel cap can engage the replaceable sill deck as described in the embodiments above and shown in FIGS. 1 through 11D.

The replaceable sill deck and temporary protective covers as described herein can be used with substrates formed of two or more substrate sections attached and interlocked together end-to-end (not shown). Such interlocking substrates are described in U.S. Pat. No. 7,350,336, the entirety of which is herein incorporated by reference. In an embodiment, the substrate can be comprised of at least first and second substrate sections. The first substrate section can have dovetail tongues on one end thereof, and dovetail grooves on the other end thereof. The dovetail tongue of the first substrate section can be received with an interlocked with the dovetail groove of second substrate section. In another embodiment, the substrate can have first substrate section having at least one protruding element along one end of the substrate section. A second substrate section can have at least one slot at one end of the second substrate section. The protruding elements of the first substrate section can slidingly engage in an end-to-end relationship with the slot of the second substrate section. The interlocking substrates can engage a nosing cover and replaceable sill deck as described in the embodiments above and shown in FIGS. 1 through 11D.

Although the present invention has been described with exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. A door sill assembly for an entryway of a building, the entryway having jambs, the door sill assembly comprising:
- a substrate having a nosing and a sill channel;
- a nosing cover attached to the substrate and extending over at least a portion of the nosing and over at least a portion of the sill channel; and
- a sill deck on the substrate, the sill deck comprising:
  - a deck and a clip,
  - the deck engaged with a portion of the nosing cover,
  - the clip operably engaged with the deck, and the clip being removably attachable to the substrate,
  - wherein the deck is capable of being slid away from the sill channel, without damage to at least one of the jambs or to the substrate, to be removed from the door sill assembly before or after the door sill assembly is installed in the entryway.

2. The door sill assembly of claim 1, wherein the clip is attached to the substrate in such a manner to restrict vertical and horizontal displacement of the clip.

3. The door sill assembly of claim 1, wherein the clip is slidably removable from the deck and the substrate.

4. The door sill assembly of claim 1, wherein the clip is rotatably connected to the deck.

5. The door sill assembly of claim 1, wherein the clip further comprises a slot for inserting a tool therein that can be used to disengage the clip from the substrate.

6. The door sill assembly of claim 1, the nosing cover further comprising a dam spaced from the nosing, the nosing cover having at least one projection extending from the dam.

7. The door sill assembly of claim 6, the deck having a channel for receiving the at least one projection.

8. The door sill assembly of claim 1, wherein the nosing cover comprises a first projection and a second projection, the first projection being received by a channel of the deck and the second projection being received by the substrate.

9. The door sill assembly of claim 1, wherein the sill deck comprises a means for removably attaching to the substrate and the nosing cover.

10. The door sill assembly of claim 1, further comprising a sill cap, wherein the sill cap comprises a leg, the leg having a distal end comprising a flexible member;

wherein, when the flexible member is in contact with the deck, a seal is formed.

11. The door sill assembly of claim 1, wherein the deck comprises:

a first end and a second end, and a curved slot on the second end, wherein the clip further comprises a leg, the curved slot on the deck configured to receive at least a portion of the leg so that the clip can pivot about the second end of the deck.

12. The door sill assembly of claim 11, wherein the substrate further comprises a first end, a second end, and a bottom, and a lip extending from the second end and having a bottom surface, the end of the clip engaging the bottom surface of the substrate.

13. The door sill assembly of claim 1, further comprising a sill cap received by the sill channel, the sill cap having length that is less than the length of the door sill assembly, the sill cap being repositionable in any portion of the sill channel in the entryway.

14. The door sill assembly of claim 1, wherein the substrate has a major axis having a length and further comprises at least two substrate sections interlocked end-to-end along the length, at least one seam defined by any two adjacent substrate sections, the nosing cover spanning the at least one seam.

15. A method of removing a sill deck from a door sill assembly, comprising the steps of:

a) providing a door sill assembly, the door sill assembly comprising:

a substrate having a nosing and a sill channel;

a nosing cover attached to the substrate and extending over at least a portion of the nosing and over at least a portion of the sill channel; and a sill deck on the substrate, the sill deck comprising:

a deck and a clip, the deck engaged with a portion of the nosing cover, the clip operably engaged with the deck, and the clip being removably attachable to the substrate;

b) installing the door sill assembly between jambs in an entryway;

c) disengaging the clip from the substrate; and d) sliding the deck away from the sill channel without damaging at least one of the jambs or the substrate, in order to remove the deck from the door sill assembly after the door sill assembly was installed between the jambs.

16. A method of attaching a sill deck to a door sill assembly, comprising the steps of:

a) providing an entryway defined between jambs;

b) providing a partial door sill assembly, the partial door sill assembly comprising:

a substrate having a nosing and a sill channel;

a nosing cover attached to the substrate and extending over at least a portion of the nosing and over at least a portion of the sill channel;

c) installing the partial door sill assembly between the jambs;

d) providing a sill deck, the sill deck comprising:

a deck and a clip, e) sliding, after the partial door sill assembly is installed, the sill deck along the substrate toward the sill channel, without damaging at least one of the jambs or the substrate, until the deck is engaged with the nosing cover; and f) engaging the clip to the substrate.

* * * * *